United States Patent [19]

Stolle et al.

[11] Patent Number: 4,969,810

[45] Date of Patent: Nov. 13, 1990

[54] SPIRAL DISPLACEMENT MACHINE WITH RADIALLY INNER SEAL GAP FOR TEMPERATURE EXPANSION

[75] Inventors: Günter Stolle; Helga Wellbrock, both of Wolfsburg, Fed. Rep. of Germany

[73] Assignee: Volkswagen AG, Wolfsburg, Fed. Rep. of Germany

[21] Appl. No.: 483,962

[22] Filed: Feb. 9, 1990

Related U.S. Application Data

[63] Continuation of Ser. No. 219,310, Jul. 14, 1988, abandoned.

[30] Foreign Application Priority Data

Aug. 26, 1987 [DE] Fed. Rep. of Germany ..... 3728439

[51] Int. Cl.[5] ..... F01C 1/04; F01C 19/08; F16J 15/34

[52] U.S. Cl. ..... 418/55.4; 418/83; 418/142; 277/26; 277/81 P; 277/204

[58] Field of Search ..... 418/55 C, 83, 142; 277/26, 81 P, 81 R, 95, 134, 152, 153, 204

[56] References Cited

U.S. PATENT DOCUMENTS 4,722,676 2/1988 Sugimoto ..... 277/26

FOREIGN PATENT DOCUMENTS 158598 11/1978 Netherlands ..... 277/26

*Primary Examiner*—John J. Vrablik

*Attorney, Agent, or Firm*—Brambaugh, Graves, Donohue & Raymond

[57] ABSTRACT

A spiral displacement machine for compressible media is described which has at least one displacement chamber in the form of a spiral-shaped groove arranged in a stationary housing and also has a spiral rib-shaped displacement body associated with each displacement chamber. Each displacement body is on the side of a disc-shaped rotor which is driven eccentrically in a translatory movement relative to the housing. During operation, each peripheral point of the displacement body performs a circular movement bounded by the peripheral walls of the associated displacement chamber. At the edges of the displacement bodies and of the housing walls forming the displacement chambers, sealing strips mounted in spiral grooves engage the adjacent surfaces of the other component of the machine. In order to ensure the most uniform possible application of the sealing strips against the adjacent surfaces during hot operating states of the displacement machine, the depth of the spiral-shaped sealing grooves and/or the height of the sealing strips is varied over the length of the spiral so that, at ambient temperature, when the sealing strips engage the bottom of the groove, the sealing gap at the radially inner end of the spiral is larger than at the outer end by an amount equal to the difference in expansion of the components at those ends during operation.

9 Claims, 4 Drawing Sheets

SPIRAL DISPLACEMENT MACHINE WITH RADIALLY INNER SEAL GAP FOR TEMPERATURE EXPANSION

This application is a continuation of application Ser. No. 219,310, filed on July 14, 1988, abandoned.

BACKGROUND OF THE INVENTION

This invention relates to spiral displacement machines for compressible media and, more particularly, to a new and improved displacement machine with a more effective seal arrangement.

Spiral displacement machines having a spiral displacement chamber in a stationary housing and a spiral displacement body rotatably movable in the chamber and having sealing strips engaging the support for the displacement body and the walls of the displacement chamber, which may be used as charging or compressor devices for the engines of passenger automobiles, are described, for example, in *Motortechnische Zeitschrift.* 1985, pp. 323–327. It has been found that, during operation of such spiral displacement machines, the wear and tear on the sealing strips varies along the length of the spiral body because of the differing axial thermal expansions of the spiral displacement bodies and the spiral housing walls forming the displacement chamber. The wear and tear is always substantially greater on the radially inner end of the spiral than on the radially outer end of the spiral during operation as a compressor since the compressible medium has a higher temperature in the radially inner outlet region of the housing than in the radially outer inlet region.

SUMMARY OF THE INVENTION

Therefore, it is an object of the present invention to provide a spiral displacement machine in which the above-mentioned disadvantages of the prior art are overcome.

Another object of the invention is to provide a displacement machine having sealing strips mounted in the edges of the displacement body wherein the occurrence of varying wear and tear along the edges of the displacement body is avoided.

These and other objects of the invention are attained by providing a displacement machine with a spiral displacement body having sealing strips received in grooves in the edges of the spiral body wherein the depth of the groove or the height of the sealing strip or both are varied between the inner end of the spiral and the outer end so that at ambient temperature, before start-up, with the sealing strip at the bottom of the groove, the seal gap at the inner end of the spiral is larger than that at the outer end by the difference in expansion at the inner end with respect to that at the outer end at the operating temperature of the displacement machine. In order to ensure the most uniform possible application of the sealing strips against the adjacent surfaces during hot operating states of the displacement machine, the depth of the spiral-shaped sealing grooves and/or the height of the sealing strips is varied over the length of the spiral so that, at ambient temperature, when the sealing strips engage the bottom of the groove, the sealing gap at the radially inner end of the spiral is larger than at the outer end by an amount equal to the difference in expansion of the components at those ends during operation. Because the depth of the spiral grooves and/or the height of the sealing strips varies along the periphery of the spiral, the different axial thermal expansions of the displacement bodies and housing walls are taken into account from the start. The depth of the spiral grooves may be reduced either continuously or stepwise from the radially inner end of the spiral and the height of the sealing strips may be correspondingly increased. This change in the depth of the spiral groves and/or the height of the sealing strips extends over an angular range of at least 180° starting at the radially inner end of the spiral since, in that region, the thermal expansion is especially large due to the higher operating medium temperature.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
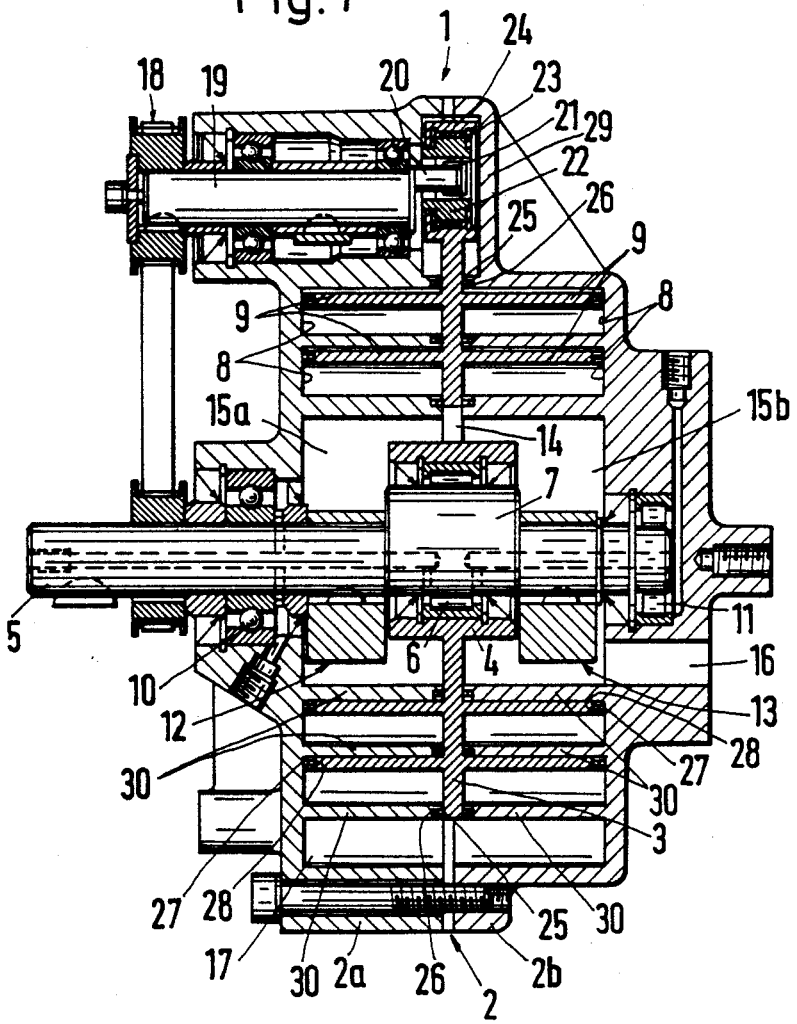
FIG. 1 is a view in longitudinal section through a representative spiral displacement machine arranged according to the invention.
Figure 2:
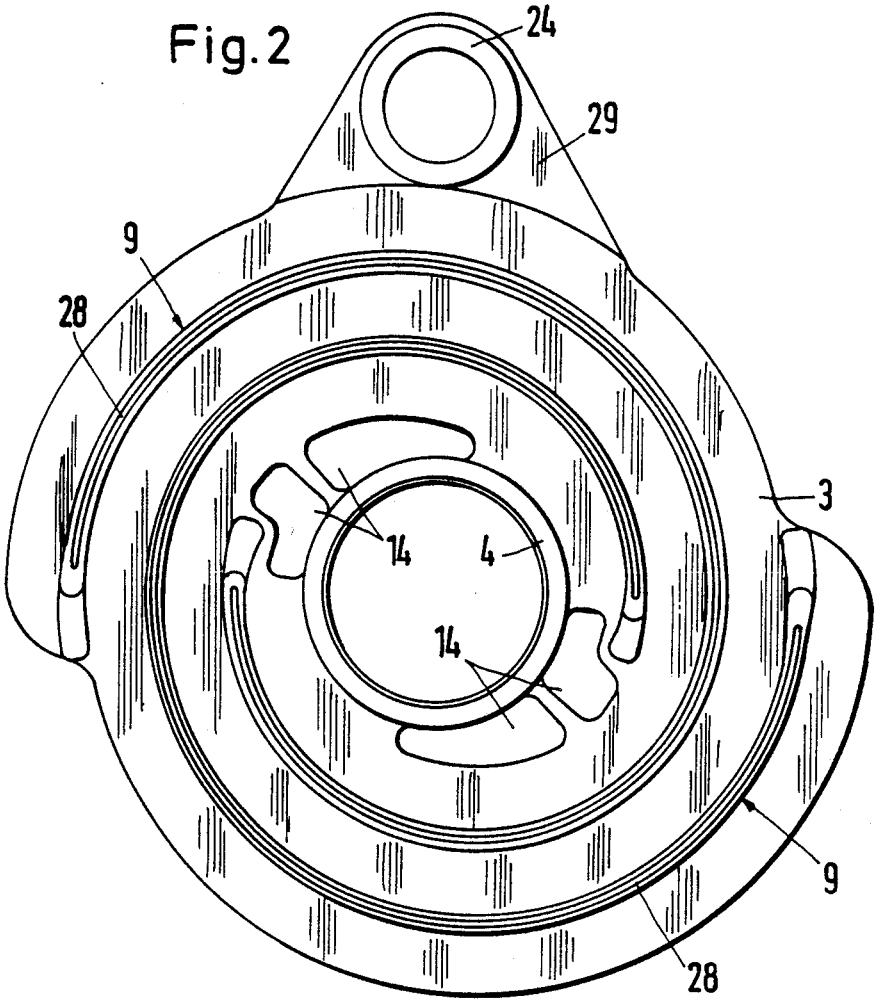
FIG. 2 is a side view of a disc-shaped rotor for the spiral displacement machine of FIG. 1.

FIG. 1 illustrates a typical displacement machine 1 of spiral construction which can be employed as a supercharger for the combustion engine of a passenger automobile. The displacement machine 1 has a housing 2 subdivided by a center radial joint into two housing sections 2*a* and 2*b*. Between the two housing sections 2*a* and 2*b*, a disc-shaped rotor 3 is rotatably supported by a center hub 4 on a drive shaft 5. The hub 4 is mounted on an anti-friction bearing 6 carried by an eccentric portion 7 of the drive shaft 5, which constitutes a first eccentric device of the displacement machine.

In each of the two housing sections 2*a* and 2*b*, there is a spiral displacement chamber 8. These displacement chambers 8 contain spiral displacement bodies 9 which project essentially perpendicularly in the form of ribs from the two side faces of the disc-shaped rotor 3. In the embodiment shown in the drawings, two spiral displacement bodies 9 are arranged on each side of the rotor 3, and there are two corresponding spiral displacement chambers 8 in each housing section 2a and 2b.

The drive shaft 5 is supported by two bearings 10 and 11 disposed on opposite sides of the eccentric portion 7 and two balancing weights 12 and 13 are mounted between the eccentric portion 7 and the bearings 10 and 11, respectively. The balancing weights 12 and 13 counteract the centrifugal force on the shaft 5 caused by the eccentric motion of the rotor 3. The balancing weights 12 and 13 rotate in corresponding chambers 15a and 15b which are connected by corresponding passages 14 in the disc-shaped rotor 3. The chambers 15a and 15b communicate with at least one outlet opening 16 provided in the housing section 2b for discharge of the operating medium and they serve as reservoirs for the operating medium conveyed to them during operation of the supercharger. As a result of the eccentric motion of the spiral displacement body 9 in the displacement chambers 8, the operating medium is conveyed from an inlet chamber 17 provided in the outer portion of the housing 2 through the spiral displacement chambers 8 towards the chambers 15a and 15b at the inner part of the housing 2.

In order to guide the disc-shaped rotor 3, a second eccentric arrangement is provided by an eccentric pivot 20 arranged on a secondary shaft 19 which is mounted in the housing section 2a parallel to the drive shaft 5. The eccentric pivot 20 is received in a bearing 21 in a bearing boss 24 formed in a projecting part 29 on the outer periphery of the rotor 3. An intermediate ring 22 may be provided between the bearing boss 24 and the bearing 21, the ring 22 being held in the boss 24 by an elastic seat 23. The secondary shaft 19 is rotated synchronously with the drive shaft 5 by a toothed belt 18.

As a result of the second eccentric arrangement, the disc-shaped rotor 3, when driven by the eccentric portion 7 of the drive shaft 5, follows a translatory motion in which all points of the rotor 3 describe circles with a diameter equaling twice the eccentricity of the eccentric devices 7 and 20, respectively. Likewise, each part of the displacement bodies 9 formed on the disc-shaped rotor 3 has a circular motion bounded by the peripheral walls of the displacement chambers 8. Consequently, a plurality of sickle-shaped working chambers which are formed between the displacement chambers 8 and the displacement bodies 9 move through the displacement chambers 8 from the outside towards the inside when the rotor 3 is driven.

To seal the spaces between the displacement bodies 9 on the disc-shaped rotor 3 and the adjacent walls of the housing 2, sealing strips 25 and 27 are mounted in grooves 26 and 28, respectively, in the edges of the rib-like displacement bodies 9 and in the edges of rib-like chamber walls 30 extending between the displacement chambers. Each of the sealing strips has a length corresponding to the spiral length of the ribs. The sealing strips 25 and 27 engage the sides of the disc-shaped rotor 3 and the inner walls of the displacement chambers 8, respectively, and provide seals between the separate working chambers formed on either side of the displacement bodies 9. If desired, a spring arrangement, such as corrugated springs with a selected tension (not shown), may be provided in the bottom of the grooves 26 and 28 to exert pressure on the sealing strips 25 and 27 so that they are urged against the adjacent surfaces.

During operation of the displacement machine, the temperature of the operating medium conveyed from the radially outer reservoir 17 to the radially inner reservoirs 15a and 15b increases, causing thermal expansion of the rib-like displacement bodies 9 and the housing walls 20 which varies in magnitude depending on the temperature of the adjacent working medium.

Figure 3:
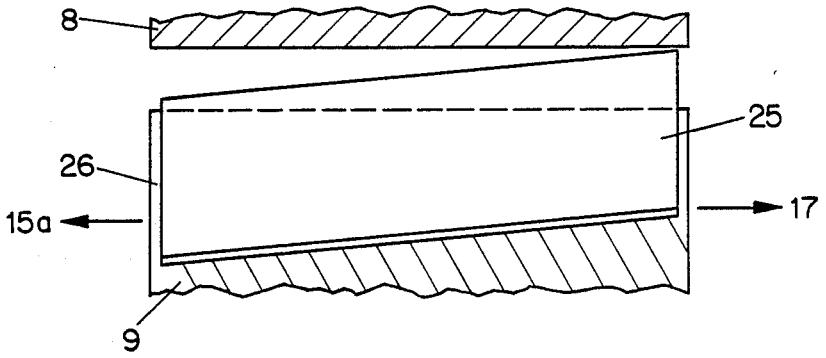
FIG. 3 is a developed view of a spiral groove with its depth continuously reduced from the radial interior to the radial exterior and a sealing strip of a constant height.
Figure 4:
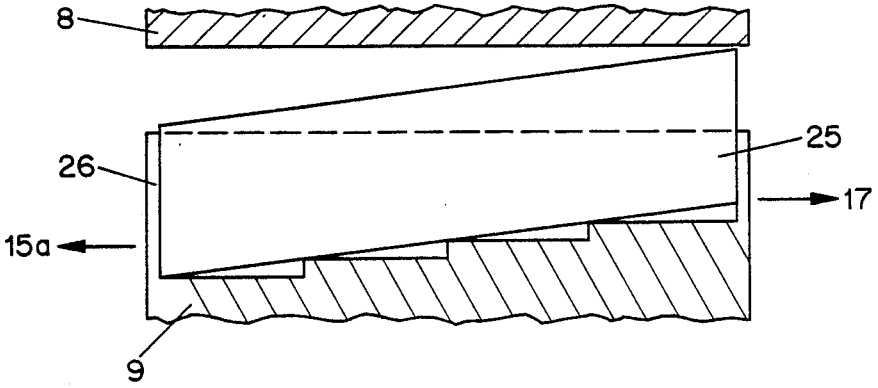
FIG. 4 is a developed view of a spiral groove with its depth reduced in steps from the radial interior to the radial exterior and a sealing strip of constant height.
Figure 5:
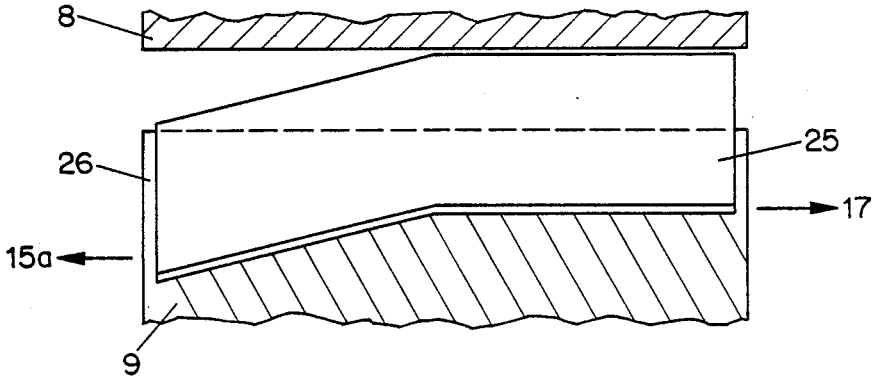
FIG. 5 is a developed view of a spiral groove with its depth reduced continuously from the radial interior over an angular region of at least 180° of the groove and a sealing strip of constant height.

Inasmuch as the working medium has a substantially higher temperature due to compression in the radially inner region of the housing 2 than in the radially outer input region, the thermal expansion of these elements is substantially greater in the radially inner region of their spiral length than in their radially outer region. This thermal expansion, which varies over the spiral length, must be largely accommodated by varying the depth of the spiral grooves 26 and 28 which receive the sealing strips along the length of the spiral shape. Thus, the depth of the spiral grooves at their radially inner end, i.e., at the end adjacent to the discharge chambers 15a and 15b, must be larger than the depth at the radially outer end of the spiral adjacent to the inlet chamber 17. For this purpose, the depth of the spiral grooves 26 and 28 may be reduced continuously as shown in FIG. 3 or stepwise as shown in FIG. 4 starting at the radially inner end of the spiral. In some cases, it may be sufficient to vary the depth of the groove only in the inner portion of the spiral extending over an angle of 180° as seen from the side of the disc-shaped rotor 3 and adjacent to the radially inner end of the spiral, while the remaining part has a constant groove depth as shown in FIG. 5.

Figure 6:
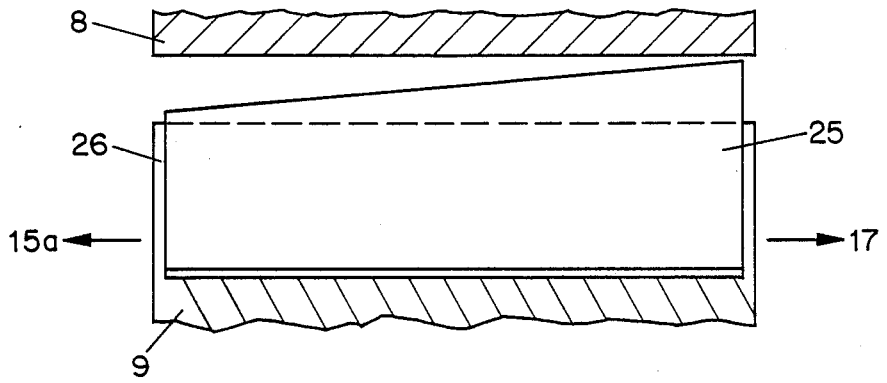
FIG. 6 is a developed view of a spiral groove of constant depth and a sealing strip with its height continuously increased from the radial interior to the radial exterior.
Figure 7:
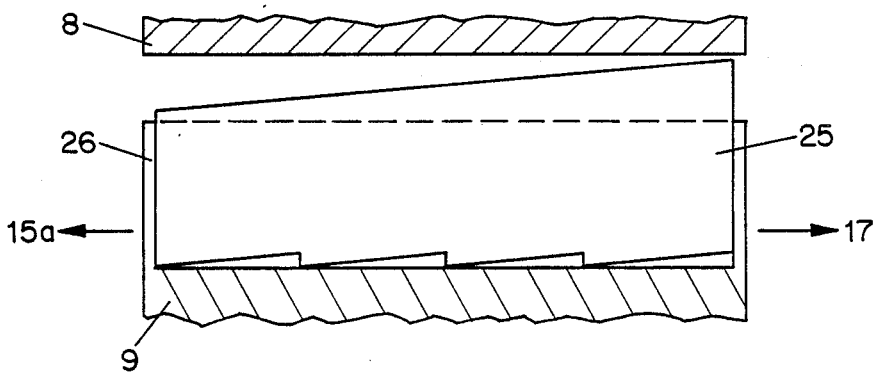
FIG. 7 is a developed view of a spiral groove of constant depth and a sealing strip with its height increased in steps from the radial interior to the radial exterior.
Figure 8:
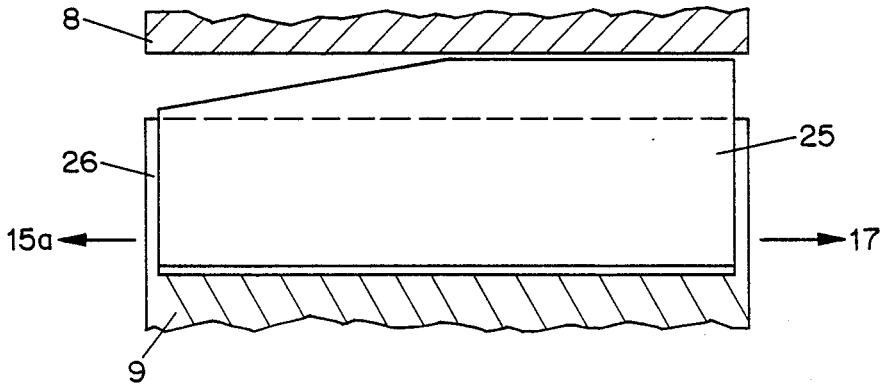
FIG. 8 is a developed view of a spiral groove of constant depth and a sealing strip with its height increased continuously from the radial interior over an angular region of at least 180° of the groove.

Instead of varying the depth of the spiral grooves 26 and 28, the height of the sealing strips 25 and 27 may be varied while the groove depth remains constant. In that case, the height of the sealing strips is smallest at the radially inner end of, the spiral and increases continually as shown in FIG. 6 or stepwise as shown in FIG. 7 toward the outer end of the spiral. Again, the change in strip height may be limited to the first 180° of the spiral starting at the radially inner end as shown in FIG. 8. It is also possible to take both measures at the same time, i.e., to vary the groove depth as described above and also vary the height of the sealing strip. The extent of the combined groove depth variation and sealing strip height variation may be, for example, about 0.1 to 0.2 mm at the radially inner end of the spiral.

In any case, this measure ensures that during operation the larger axial thermal expansion occurring in the radially inner region of the spiral due to the increased temperature of the working medium is compensated by a corresponding increase in the groove depth and/or decrease in sealing strip height. With this arrangement, on the one hand, an approximately constant application of the sealing strip can be maintained by a spring element which may be located in the bottom of the groove and, on the other hand, by varying the groove depth and/or the sealing strip height, excessive wear and tear on the sealing strip during operation of the displacement machine can be substantially avoided. At the same time, the improved seal arrangement reduces the friction which is produced by engagement of the radially inner regions of the sealing strips during starting-up of a displacement machine having closely fitting sealing strips. In the cold starting condition, the sealing gap at the radially inner end of the displacement bodies 9 and the adjacent housing walls 30 is correspondingly larger, so that during starting-up of the machine, but only during this relatively short time span, a loss of pressure due to incomplete sealing of the operating spaces will occur.

Although the invention has been described herein with reference to specific embodiments, many modifications and variations of the invention will be obvious to those skilled in the art. Accordingly, all such variations and modifications are included within the intended scope of the invention.

We claim:

1. A displacement machine for compressible media comprising a stationary housing including at least one spiral displacement chamber having spiral walls and an inner wall, a spiral displacement body associated with the displacement chamber, the displacement body being supported on a disc-shaped rotor mounted for eccentric translatory movement so that, during operation, each peripheral point of the displacement body follows a circular path bounded by the spiral walls of the displacement chamber, the spiral walls having edges formed with spiral grooves adjacent to the disc-shaped rotor and the displacement body having an edge formed with a spiral groove adjacent to the inner wall of the displacement chamber, and sealing strips held in the spiral groove of the displacement body to engage the inner wall of the housing and in the spiral grooves of the housing walls to engage the disc-shaped rotor, the sealing strips providing a sealing gap along their entire length which varies so that, when the machine is at ambient temperature and the sealing strips engage the bottom of the groove, the sealing gap at the radially inner end of the spiral is larger than that at the radially outer end by an amount equal to the difference in expansion of the components at the operating temperature of the machine such that, at the operating temperature of the machine, the sealing strips are applied uniformly to the adjacent wall surfaces.

2. A spiral displacement machine according to claim 1 wherein the depth of the spiral grooves decreases between the inner end of the spiral and the outer end.

3. A spiral displacement machine according to claim 2 wherein the depth of the spiral grooves decreases in a continuous manner.

4. A spiral displacement machine according to claim 2 wherein the depth of the spiral grooves decreases in a stepwise manner.

5. A spiral displacement machine according to claim 2 wherein the depth of the spiral grooves decreases over an angular region of at least 180° starting at the radially inner end of the spiral.

6. A spiral displacement machine according to claim 1 wherein the height of the sealing strips increases between the inner end and the outer end.

7. A spiral displacement machine according to claim 6 wherein the height of the sealing strips increases in a continuous manner.

8. A spiral displacement machine according to claim 6 wherein the height of the sealing strips increases in a stepwise manner.

9. A spiral displacement machine according to claim 6 wherein the height of the sealing strips increases over an angular region of at least 180° starting at the radially inner end of the spiral.

* * * * *

UNITED STATES PATENT AND TRADEMARK OFFICE

CERTIFICATE OF CORRECTION

PATENT NO. : 4,969,810

DATED : November 13, 1990

INVENTOR(S) : Stolle et al.

It is certified that error appears in the above-identified patent and that said Letters Patent is hereby corrected as shown below:

Column 4, line 3, "walls 20" should read --walls 30--;

Column 6, line 2, after "surfaces" insert --along the entire length of the grooves--.

Signed and Sealed this

Eighteenth Day of August, 1992

*Attest:*

DOUGLAS B. COMER

*Attesting Officer*

*Acting Commissioner of Patents and Trademarks*